US005959446A

United States Patent [19]

Kuckreja

[11] Patent Number: 5,959,446

[45] Date of Patent: Sep. 28, 1999

[54] HIGH SWING CURRENT EFFICIENT CMOS CASCODE CURRENT MIRROR

[75] Inventor: Ajay Kuckreja, Fort Collins, Colo.

[73] Assignee: National Semiconductor Corporation, Santa Clara, Calif.

[21] Appl. No.: 09/118,347

[22] Filed: Jul. 17, 1998

[51] Int. Cl.[6] ..... G05F 3/16; G05F 1/10

[52] U.S. Cl. ..... 323/315; 327/530; 327/538

[58] Field of Search ..... 323/315, 313, 323/314, 312; 327/538, 542, 530, 543

[56] References Cited

U.S. PATENT DOCUMENTS 4,583,037 4/1986 Sooch ..... 323/315

4,897,596 1/1990 Hughes et al. ..... 323/315

5,640,122 6/1997 McClure ..... 327/530

*Primary Examiner*—Peter S. Wong

*Assistant Examiner*—Rajnikant B. Patel

*Attorney, Agent, or Firm*—Skjerven Morrill MacPherson Franklin & Friel LLP; Edward C. Kwok

[57] ABSTRACT

A current mirror having a high output voltage swing and which uses only one reference current source. The current source provides an output current that is substantially equal to the reference current and, as such, does not suffer from a current offset. The current mirror achieves body-effect cancellation, permits easy scaling of current consumption and provides for fast charging and discharging of the bias lines.

6 Claims, 3 Drawing Sheets

HIGH SWING CURRENT EFFICIENT CMOS CASCODE CURRENT MIRROR

FIELD OF THE INVENTION

The present invention relates to current mirrors and, more specifically, to CMOS cascode current mirrors requiring high output voltage swing and low power consumption.

DESCRIPTION OF THE RELATED ART

Current mirrors are widely used in analog circuits. As DC biasing elements, current mirrors are used extensively to establish the DC bias levels within a circuit providing a much reduced sensitivity to power supply and temperature variations of the overall circuit performance. Current mirrors are also widely used as load devices in amplifier stages. The high incremental impedance of the current mirror results in high voltage gain of amplifier stages at low power supply voltages.

A current mirror operates based on the principle that a reference current in a constant current stage is substantially reproduced, i.e. mirrored, in a second stage, independent of the device parameters of the second stage.

FIG. 1 illustrates a CMOS cascode current mirror 200 as known in the prior art. A major limitation of current mirror 200 is the maximum allowable output voltage swing. To prevent transistors M2 and M4 from entering triode region, output voltage $V_o$ must be maintained above $V_T+2*V_{DSAT}$ volts where, $V_T$=Threshold voltage of an MOS transistor $V_{DSAT}$=Saturation drain-to-source voltage of an MOS transistor The $V_{DSAT}$ term can be made small by using in a transistor a large channel width and biasing the transistors at low current. The threshold voltage term $V_T$, however, represents a significant loss of voltage swing, especially when the current mirror is used as a load device in an amplifier stage.

FIG. 2 illustrates a prior art CMOS cascode current mirror 300, known in the art as the Gray-Meyer cascode. Transistor M6 in current mirror 300 is used as a voltage level-shifter, setting the voltage at the gate terminal of transistor M4 to $V_T+2*V_{DSAT}$ volts, thereby allowing transistor M4 and M2 to remain in the saturation region until output voltage $V_o$ falls below $2*V_{DSAT}$ volts. Although current mirror 300 provides an improvement over current mirror 200, by allowing a minimum voltage $V_o$ at the output node O that is a threshold voltage $V_T$ smaller than that of FIG. 1., it suffers from two major disadvantages. First, output transistor M4 and the reference transistor M6 experience different degrees of body-effect. Second, because of the difference in the drain-to-source voltages of transistors M5 and M2, the output current $I_o$ and the reference current $I_{ref}$ do not match.

FIG. 3 shows a cascode current mirror 400 of the U.S. Pat. No. 4,897,596 issued to John Hughes and incorporated herein by reference. Cascode current mirror 400 suffers from two major drawbacks. First, current mirror 400 requires two reference current sources, increasing current and power consumption. Second, proper operation of current mirror 400 requires that the condition, $$V_T>2^* V_{DSAT}$$

be satisfied at all times. Consequently as the magnitude of the reference current increase, transistor saturation voltage will also increase, pushing transistor M3 into triode region.

SUMMARY

A high swing current mirror for generating an output current that is substantially the same as a reference current used in the input circuit. At least one transistor in each input circuit and output circuit exhibit the same bulk-to-source and drain-to-source voltages to achieve body-effect cancellation and finite output impedance effect cancellation, respectively, thereby providing accurate matching between the output current and the reference current.

In accordance with the present invention the cascode current mirror has a high swing and provides fast charging and discharging of the bias lines. The current mirror uses only one current source to save power. Moreover, bias currents which can be scaled down to further reduce power consumption can themselves be used as cascode current sources to establish the DC bias levels within additional circuitry.

DETAILED DESCRIPTION

Figure 1:
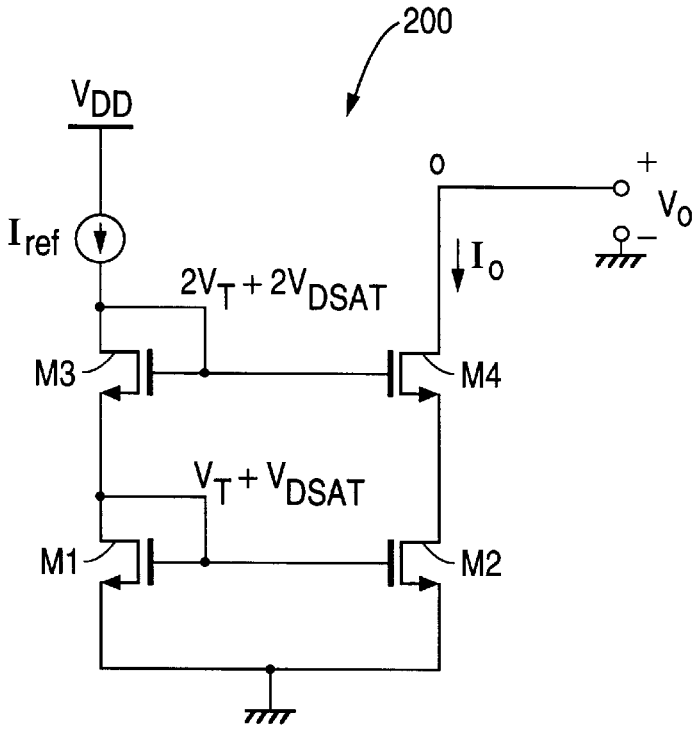
FIG. 1 (PRIOR ART)
FIG. 1 illustrates a CMOS cascode current mirror as known in the prior art.
Figure 2:
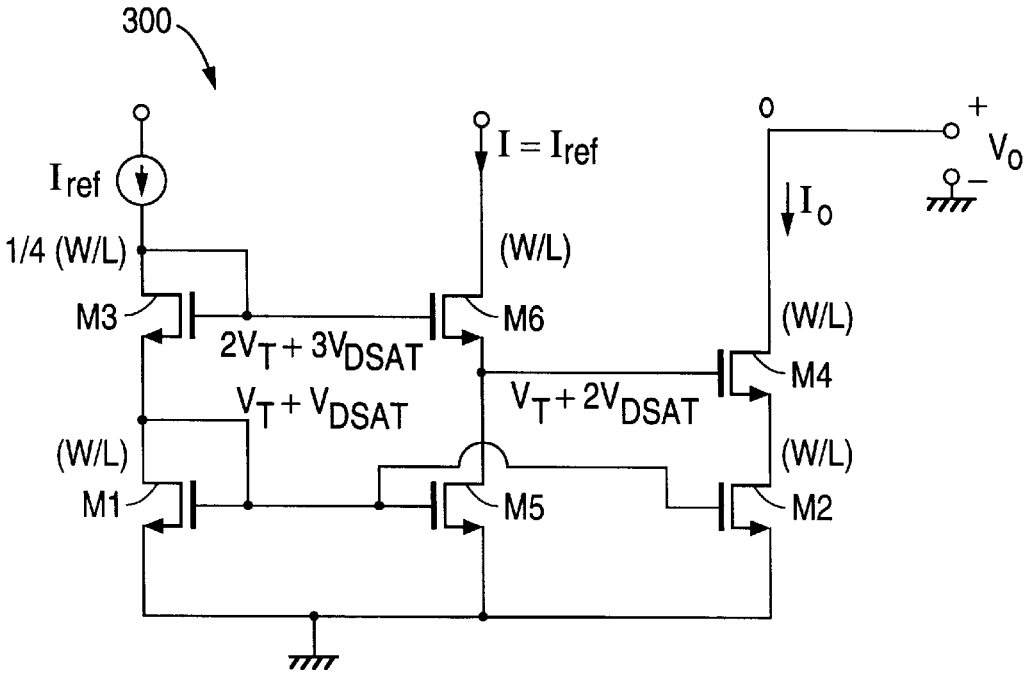
FIG. 2 (PRIOR ART)
FIG. 2 illustrate a CMOS cascode current mirror, referred to in the art as the Gray-Meyer cascode.
Figure 3:
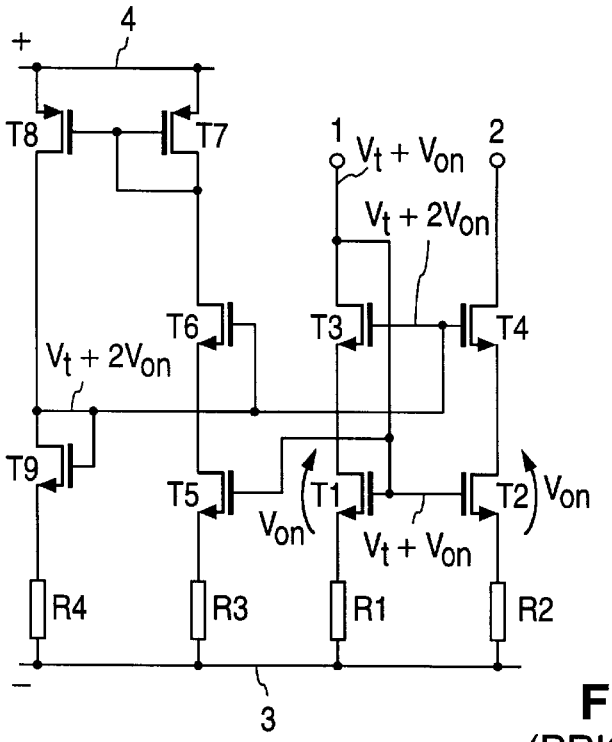
FIG. 3 (PRIOR ART)
FIG. 3 illustrates a CMOS cascode current mirror as known in the prior art.
Figure 4:
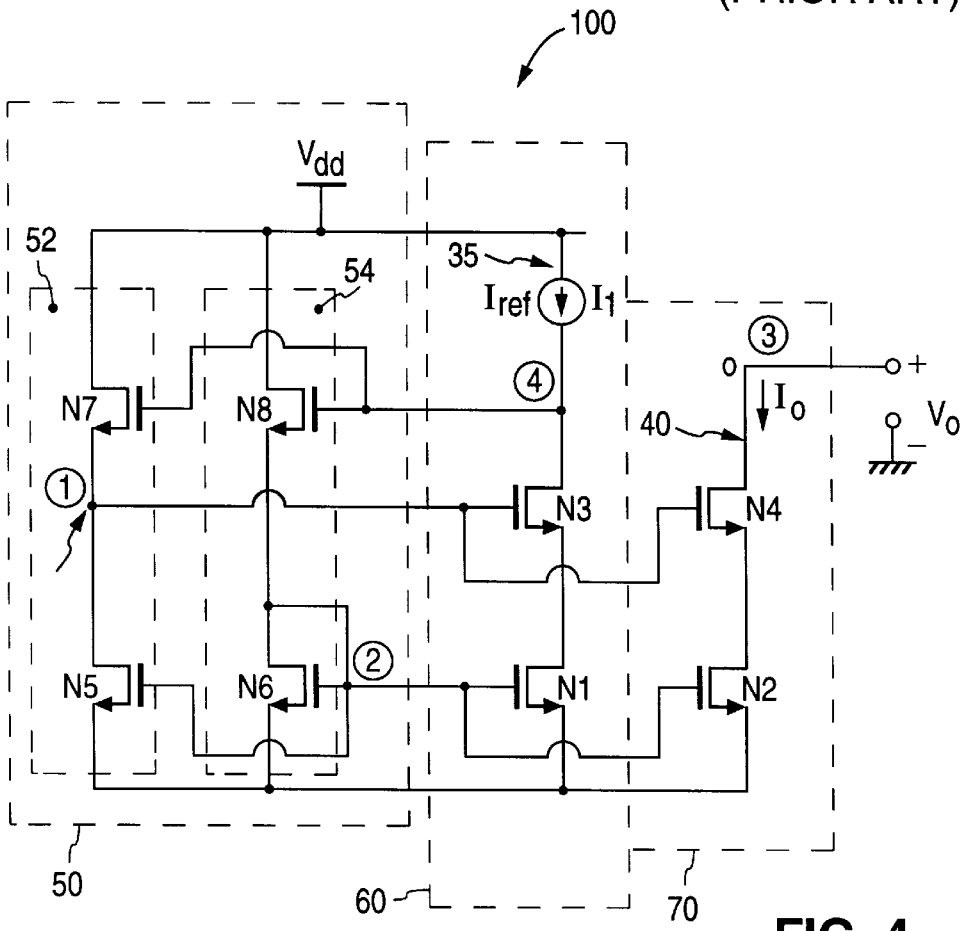
FIG. 4 illustrates a CMOS cascode current mirror in accordance with the present invention.

A current efficient CMOS cascode current mirror 100 in accordance with the present invention is illustrated in FIG. 4. Current mirror 100 includes biasing circuit 50, input circuit 60 and output circuit 70.

Input circuit 60 includes NMOS transistors N1 and N3 and current source $I_1$. Biasing circuit 50 includes NMOS transistors N5, N6, N7 and N8. The drain and the source terminals of transistor N1 are connected to the source terminal of transistor N3 and ground respectively. The gate terminals of transistors N1, N5, N6, the drain terminal of transistor N6 and the source terminal of transistor N8 are connected to node 2. The source terminals of transistors N1, N5 and N6 are connected to ground. The gate terminal of transistor N3, the drain terminal of transistor N5 and the source terminal of transistor N7 are connected to node 1. The drain terminal of transistor N3 is connected to the gate terminals of transistors N7 and N8 and to a first terminal of reference current source $I_1$. The drain terminal of transistors N7 and N8 are connected to voltage supply terminal $V_{dd}$. All transistors in biasing circuit 50, input circuit 60 and output circuit 70 have the same channel width to channel length ratio (W/L) except transistor N8 in biasing circuit 50 whose channel width to channel length ratio is equal to one-fourth the value of that of all other selected transistors. A current with a magnitude of $I_{ref}$ flows through current source $I_1$, which has a second input terminal connected to voltage supply terminal $V_{dd}$.

Output circuit 70 includes transistors N2 and N4. The source terminal and the gate terminal of transistor N2 are connected to ground and node 2 respectively. The drain terminal of transistor N2 is connected to the source terminal of transistor N4. The gate terminal of transistor N4 is connected to node 1 and the drain terminal of transistor N4 is connected to output node 3.

Transistors N7 and N5 together constitute source-follower amplifier stage 52 and transistors N6 and N8 together constitute source-follower amplifier stage 54. Output node 1 of amplifier stage 52 biases the gate terminals of transistors N3 and N4 and output node 2 of amplifier stage 54 biases the gate terminals of transistors N1, N2.

The operation of current mirror 100 is described next. Current mirror 100 is biased such that all transistors shown in biasing circuit 50, input circuit 60 and output circuit 70, namely transistor N1 through N8, operate in the saturation region. Currents flowing through transistors N1, N2, N5 and N6 are substantially equal in magnitude because these four transistors experience the same gate-to-source, drain-to-source and bulk-to-source voltages. Furthermore, by choosing in the transistors a low channel width to channel length ratio, (W/L), power consumption within the current source can be reduced.

Assuming square law characteristics, in the saturation region, the drain current of an MOS transistor can be determined according to the following equation:

$$Id=(K*W)*(V_{DSAT})^2/(2*L) \quad (1)$$

where

Id=transistor drain current

K=proportionality constant

W=transistor channel width

L=transistor channel length

Since transistor N8 is chosen to have a channel width to channel length ratio (W/L) equal to one-fourth the value of that of all the other transistors and transistors N6 and N8 are designed to have the same proportionality constant and substantially the same current, the following relationship holds:

$$(W_6/L_6)*(V_{DSAT6})^2=(W_8/L_8)*(V_{DSAT8})^2 \quad (2)$$

Where subscripts 6 and 8 denote device parameters (e.g., W, L and $V_{DSAT}$) associated with transistors N6 and N8 respectively. By design, $$(W_8/L_8)=0.25*(W_6/L_6) \quad (3)$$

Combining equations (2) and (3) it can be seen that $$V_{DSAT8}=2*V_{DSAT6} \quad (4)$$

Since the saturation voltage is the same for each of transistors N1 through N7, to simplify discussion, the quantity $V_{DSAT}$ is understood below as indicating the saturation voltage for each of transistors N1 to N7. As shown above the value of the saturation voltage $V_{DSAT8}$ for transistor N8 is twice $V_{DSAT}$. Since the source voltage of transistor N8 is at ($V_T$+$V_{DSAT}$) volts and ($V_{DSAT8}$=2 * $V_{DSAT}$), the gate voltage of transistor N8 must be at least equal to (2 * $V_T$+3 * $V_{DSAT}$) volts. As a result, the source voltage of transistor N7 is at ($V_T$+2 * $V_{DSAT}$) volts. Consequently, transistors N2 and N4 at output 70, have gate voltages of ($V_T$+$V_{DSAT}$) and ($V_T$+2 * $V_{DSAT}$) respectively, allowing the output transistors N2 and N4 to stay in saturation until the voltage $V_o$ at output node 3 falls below (2 * $V_{DSAT}$) volts.

One feature of current mirror 100 is that transistors N3 and N4 have similar body-to-source voltages, so that they experience substantially the same body-effect. Furthermore, transistors N2 and N1 have substantially the same gate-to-source and drain-to-source voltages, so that the output current $I_o$ flowing through transistors N2 and N4 is substantially the same in magnitude to the reference current $I_{ref}$ flowing through the current source $I_1$.

Another feature of current mirror 100 is that gate terminals of transistors N1 through N4 are biased by nodes 1 and 2 of source-follower amplifier stages 52 and 54 which together constitute biasing circuit 50. The low output impedance's of source-follower amplifier stages 52 and 54 allow a fast charging and discharging of output nodes 1 and 2. The use of source-follower amplifier stages 52 and 54 is an important feature as the capacitive loading at the output nodes 1 and 2 would increase when transistors N7 and N8 are used as current sources for additional stages, in which case a small compensating capacitor may be needed from high impedance node 4 to ground to avoid instability.

Another feature of current mirror 100 is that the bias currents in transistors N5 through N8 can be scaled down to reduce power consumption. By changing the channel width to channel length ratio (W/L) of transistors N5 through N8 the magnitude of currents in source-follower amplifier stages 52 and 54 could be adjusted to save power. For instance, by reducing the (W/L) ratio of transistors N5 through N8 to one-half of their original value, the magnitude of currents in amplifier stages 52 and 54 will decrease by one-half as well, allowing for an easy adjustment of the currents and thereby of the power consumed by the current mirror. Each of source-follower amplifier stages 52 and 54 could further be used as a cascode current source to bias additional circuits. For example, source-follower amplifier stage 52 can be used as a current source by disconnecting the drain terminal of transistor N7 from the supply voltage Vdd and connecting it to a first end of a circuit to be biased and applying the supply voltage Vdd to a second of that circuit.

Another feature of current mirror 100 is that transistors N4 and N2 of output circuit 40 remain in saturation so long as the voltage at output node 3 remains above 2*$V_{DSAT}$ volts, thereby allowing current mirror 100 to have a high output voltage swing.

Figure 5:
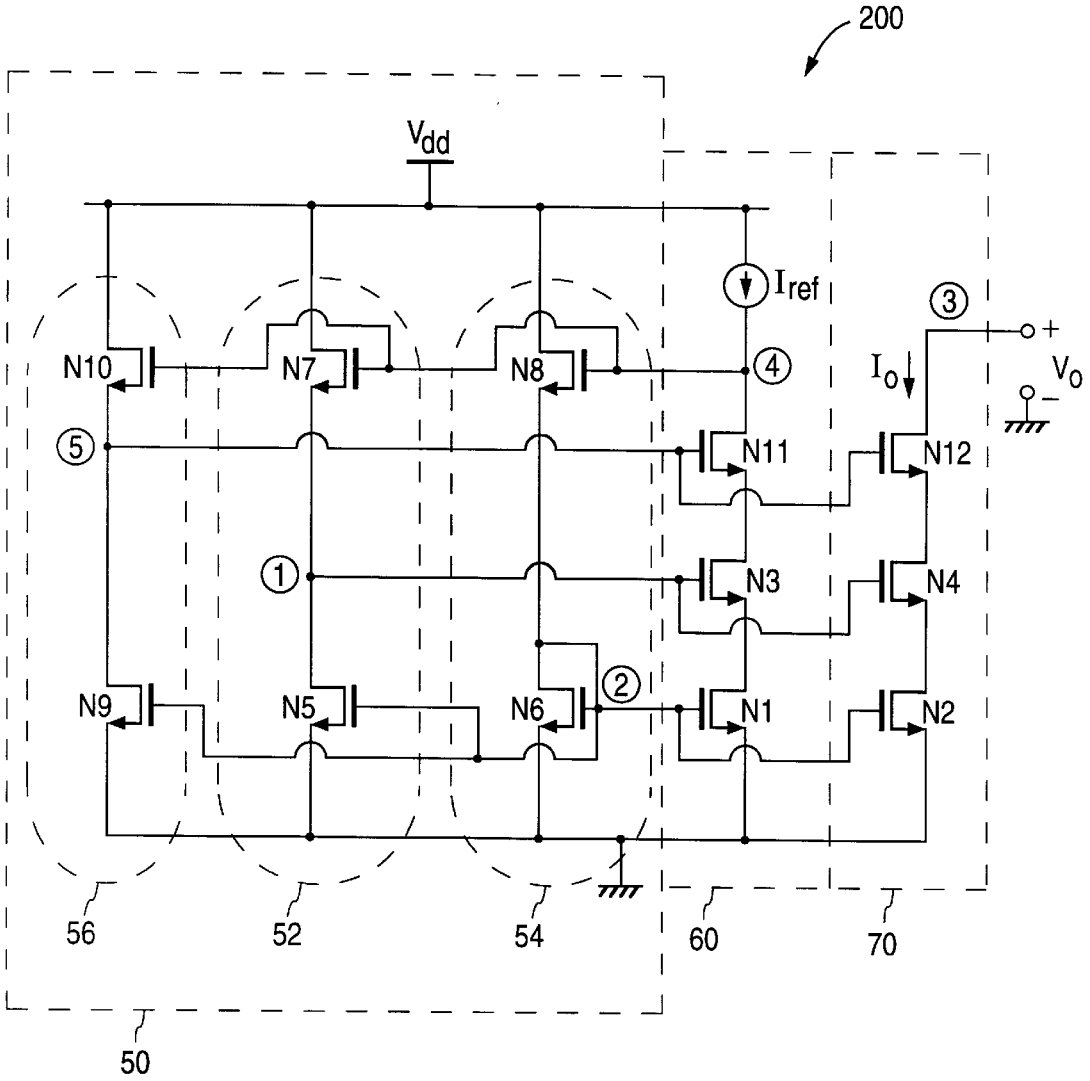
FIG. 5 illustrates a circuit 200 including an additional source-follower amplifier stage 56.

FIG. 5 shows embodiment 200 of the present invention. Embodiment 200 is similar to embodiment 100 except that it includes an additional source-follower amplifier stage 56, consisting of transistors N9 and N10, in biasing circuit 50. Embodiment 200 further includes additional cascode transistors N11 in input circuit 60 and N12 in output circuit 70.

The drain terminal of transistor N9 is connected to the source terminal of transistor N10 and to node 5. The gate and the source terminals of transistor N9 are connected to node 2 and ground, respectively. The gate terminal of transistor N10 is connected to node 4. Supply voltage Vdd is applied to the drain terminal of transistor N10. The gate terminals of transistors N11 and N12 are connected to node 5. The source terminal of transistor N11 is connected to the drain terminal of transistor N3. The drain terminal of transistor N11 is connected to node 4. The source terminal of transistor N12 is connected to the drain terminal of transistor N4. The drain terminal of transistor N12 is connected to output node 3.

In embodiment 200 transistors N7 and N8 are chosen to have a channel width to channel length ratio, (W/L), equal to one-fourth and one-ninth, respectively, of that of all the other transistors. Because all the transistors in embodiment 200 operate in the saturation region, the relationship between the currents and the voltages across each is governed by equation (1). Therefore, the drain-to-source voltages across transistors N7 and N8 are twice and three times, respectively, that of all other transistors. Consequently, the voltages at nodes 1, 4 and 5 are equal to $V_T+2 * V_{DSAT}$, $2 * V_T+4 * V_{DSAT}$ and $V_T+3 * V_{DSAT}$, respectively. Output transistors N2, N4 and N12 operate in the saturation region so long as the voltage at output node 3 remains above $3 * V_{DSAT}$. Cascode transistor N12 and N4 increase the impedance at output node 3.

One or more cascode transistors may be included in each of input circuit 60 and output circuit 70 of current mirror 200 to further increase the impedance at output node 3.

The use of N-channel MOS transistors in current mirror 100 is solely for the purpose of illustrating an exemplary embodiment of the invention. A current mirror in accordance with the present invention could also be formed from P-channel MOS transistors and is considered within the scope of this invention.

I claim:

1. A CMOS current mirror comprising:

a single reference current;

an input circuit that is responsive to said reference current;

an output circuit that produces an output current that is substantially equal to said reference current, said input and output circuits each receiving first and second reference voltages; and a biasing circuit comprising a first and a second source-follower amplifier stage for respectively generating said first and second reference voltages.

2. A CMOS current mirror according to claim 1, wherein said input circuit comprises a first and a second MOS transistor, where the drain terminal of said first MOS transistor receives the reference current and the source terminal of said first MOS transistor is connected to the drain terminal of said second MOS transistor, the gate terminal of said first MOS transistor receives said first reference voltage and the gate terminal of said second MOS transistor receives said second reference voltage; wherein the output circuit comprises a first and a second MOS transistor, where the source terminal of said first MOS transistor of said output circuit is connected to the drain terminal of said second MOS transistor of said output circuit, the gate terminal of said first MOS transistor of said output circuit is connected to the gate terminal of said first MOS transistor of said input circuit and the gate terminal of said second MOS transistor of said output circuit is connected to the gate terminal of said second MOS transistor of said input circuit.

3. The CMOS current mirror of claim 2 wherein said first source-follower amplifier includes an MOS transistor load and an MOS transistor amplifier, said MOS transistor load having a drain terminal coupled to a first voltage supply, a gate terminal coupled to the drain terminal of said first MOS transistor of said input circuit and a source terminal for generating said first reference voltage, said MOS transistor amplifier having a source terminal coupled to a second voltage supply, and a drain terminal coupled to the source terminal of said MOS transistor load.

4. The CMOS current mirror of claim 3 wherein said second source-follower amplifier includes an MOS transistor load and an MOS transistor amplifier, said MOS transistor load of said second source-follower amplifier having a drain terminal coupled to the first voltage supply, a gate terminal coupled to the drain terminal of said first MOS transistor of said input circuit and a source terminal for generating said second reference voltage, said MOS transistor amplifier of said second source-follower amplifier having a source terminal coupled to the second voltage supply, and gate and drain terminals coupled to the source terminal of said MOS transistor load of said second source-follower amplifier and to the gate terminal of said MOS transistor amplifier of said first source-follower amplifier.

5. A CMOS current mirror comprising:

a single reference current;

an input circuit that is responsive to said reference current;

an output circuit that produces an output current that is substantially equal to said reference current, said input and output circuits receiving first and second reference voltages, wherein MOS transistors in said input circuit and said output circuit receiving the same reference voltage exhibit identical gate-to-source and bulk-to-source voltages and at least one MOS transistor in each said input circuit and said output circuit exhibit identical gate-to-source, bulk-to-source and drain-to-source voltages; and a biasing circuit responsive to said reference current, said biasing circuit generating said first and said second reference voltages; wherein said input circuit comprises a first and a second MOS transistor, where the drain terminal of said first MOS transistor receives the reference current and the source terminal of said first MOS transistor is connected to the drain terminal of said second MOS transistor, the gate terminal of said first MOS transistor receives said first reference voltage and the gate terminal of said second MOS transistor receives said second reference voltage; wherein the output circuit comprises a first and a second MOS transistor, where the source terminal of said first MOS transistor of said output circuit is connected to the drain terminal of said second MOS transistor of said output circuit, the gate terminal of said first MOS transistor of said output circuit is connected to the gate terminal of said first MOS transistor of said input circuit and the gate terminal of said second MOS transistor of said output circuit is connected to the gate terminal of said second MOS transistor of said input circuit, wherein said second transistors of both the input and the output circuit exhibit the same gate-to-source voltage and the same drain-to-source voltage such that an output current flowing through said output circuit will be substantially equal to the reference current flowing through said input circuit; wherein said biasing circuit comprises first and second source-follower amplifier stages for generating said first and said second reference voltages, wherein said first source-follower amplifier stage comprises an MOS transistor amplifier and an MOS transistor load, said MOS transistor amplifier being responsive to drain voltage of said first transistor of said input circuit and having a channel width to channel length ratio that is one-fourth the value of all other selected transistors, where the gate and the drain of said MOS transistor load are connected to the gate of said second transistor of said input circuit so as to provide a current in said first amplifier stage that is the same as the reference current and wherein said second source-follower amplifier stage comprises an MOS transistor amplifier and an MOS transistor load, said MOS transistor amplifier of said second source-follower amplifier stage being responsive to drain voltage of said first transistor of said input circuit, the drain of said MOS transistor load of said second source-follower amplifier stage is connected to the source of said MOS transistor amplifier of said second source-follower amplifier stage and the gate of said MOS transistor load of said second source-follower amplifier stage is connected to the gate of said second MOS transistor of said input circuit so as to provide a current in said second amplifier stage that is the same as the reference current.

6. A CMOS current mirror comprising:

a single reference current;

an input circuit that is responsive to said reference current;

an output circuit that produces an output current that is substantially equal to said reference current, said input and output circuits each receiving first, second and third reference voltages; and a biasing circuit comprising first, second and third source-follower amplifier stages for respectively generating said first, second and third reference voltages.

* * * * *